US008596746B2

(12) United States Patent
Curcio et al.

(10) Patent No.: US 8,596,746 B2
(45) Date of Patent: Dec. 3, 2013

(54) INKJET PEN/PRINTHEAD WITH SHIPPING FLUID

(75) Inventors: Brian E. Curcio, San Diego, CA (US); Chorng Ing Sow, Singapore (SG); Alexey S. Kabalnov, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/203,633

(22) PCT Filed: Mar. 31, 2009

(86) PCT No.: PCT/US2009/038894

§ 371 (c)(1),
(2), (4) Date: Aug. 26, 2011

(87) PCT Pub. No.: WO2010/114516

PCT Pub. Date: Oct. 7, 2010

(65) Prior Publication Data

US 2011/0310181 A1 Dec. 22, 2011

(51) Int. Cl.
*B41J 2/015* (2006.01)

(52) U.S. Cl.
USPC ..... 347/20; 347/28

(58) Field of Classification Search
USPC ..... 347/17, 20, 21, 22, 28, 29, 35, 84–87, 347/92–93
See application file for complete search history.

(56) References Cited

U.S. PATENT DOCUMENTS

| | | | | |
|---|---|---|---|---|
| 4,380,772 | A | 4/1983 | Italiano | |
| 5,795,082 | A | 8/1998 | Shimada et al. | |
| 6,082,852 | A | 7/2000 | Soga et al. | |
| 6,302,533 | B1 | 10/2001 | Shimomura et al. | |
| 6,422,692 | B2 | 7/2002 | Yamazaki et al. | |
| 6,533,405 | B1 * | 3/2003 | Sleger | 347/92 |
| 6,719,416 | B2 | 4/2004 | Anma et al. | |
| 6,811,243 | B2 * | 11/2004 | Pearlstine et al. | 347/28 |
| 7,470,011 | B2 | 12/2008 | Iwasaki | |
| 2007/0076041 | A1 | 4/2007 | Tsuda | |
| 2007/0109371 | A1 | 5/2007 | Tomioka et al. | |

FOREIGN PATENT DOCUMENTS

| | | |
|---|---|---|
| EP | 1356946 A1 | 10/2003 |
| JP | 2003310 | 1/1990 |
| JP | 2004-017388 | 1/2004 |
| JP | 2004-066599 | 3/2004 |

OTHER PUBLICATIONS

Supplementary European Search Report for Application No. EP09842801.4. Report issued Aparil 26, 2013.

* cited by examiner

*Primary Examiner* — Juanita D Jackson
(74) *Attorney, Agent, or Firm* — Nathan R. Rieth

(57) ABSTRACT

An inkjet pen includes a printhead firing chamber, a nozzle plate having at least one nozzle in fluid communication with the firing chamber, and a layer of shipping fluid within the firing chamber and covering the nozzle plate and the at least one nozzle. The shipping fluid has a density that is different than that of the ink that will be ejected from the firing chamber to form an image on media.

15 Claims, 8 Drawing Sheets

INKJET PEN/PRINTHEAD WITH SHIPPING FLUID

BACKGROUND

Inkjet printing systems use pigment-based inks and dye-based inks. There are advantages and disadvantages with both these types of ink. For example, in dye-based inks the dye particles are dissolved in liquid and the ink therefore tends to soak into the paper more. This makes the ink less efficient and can reduce the image quality as the ink bleeds at the edges of the image. Methods for overcoming this problem include drying the ink more quickly when it is applied to the paper, using harder paper, and using special coatings on the paper.

In pigment-based inks, the pigment particles are larger and remain in suspension rather than dissolving in liquid. This helps pigment inks remain more on the surface of the paper rather than soaking into the paper. Pigment ink is therefore more efficient than dye ink because less ink is needed to create the same color intensity in a printed image. Pigment inks also tend to be more durable and permanent than dye inks. For example, pigment inks smear less than dye inks when they encounter water.

One drawback with using pigment-based inks in an inkjet system, however, is the out-of-box performance of the inkjet printheads after shipping and prolonged storage of inkjet pens. Inkjet pens have a printhead affixed at one end which is internally coupled to a supply of ink. The ink supply may be self-contained within the pen body or it may reside on the printer outside of the pen and be coupled to the printhead through the pen body.

Pigment inks consist of an ink vehicle and high concentrations of insoluble pigment particles typically coated with a dispersant that enables the particles to remain suspended in the ink vehicle. Over long periods of storage of an inkjet pen, gravitational effects on the large pigment particles and/or degradation of the dispersant can cause pigment settling or crashing, which can impede or completely block ink flow to the firing chambers and nozzles in the printhead. The result is poor out-of-box performance by the printhead and reduced image quality. In dye-based inks the dye particles are more fully dissolved in liquid, so this problem is mostly avoided.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
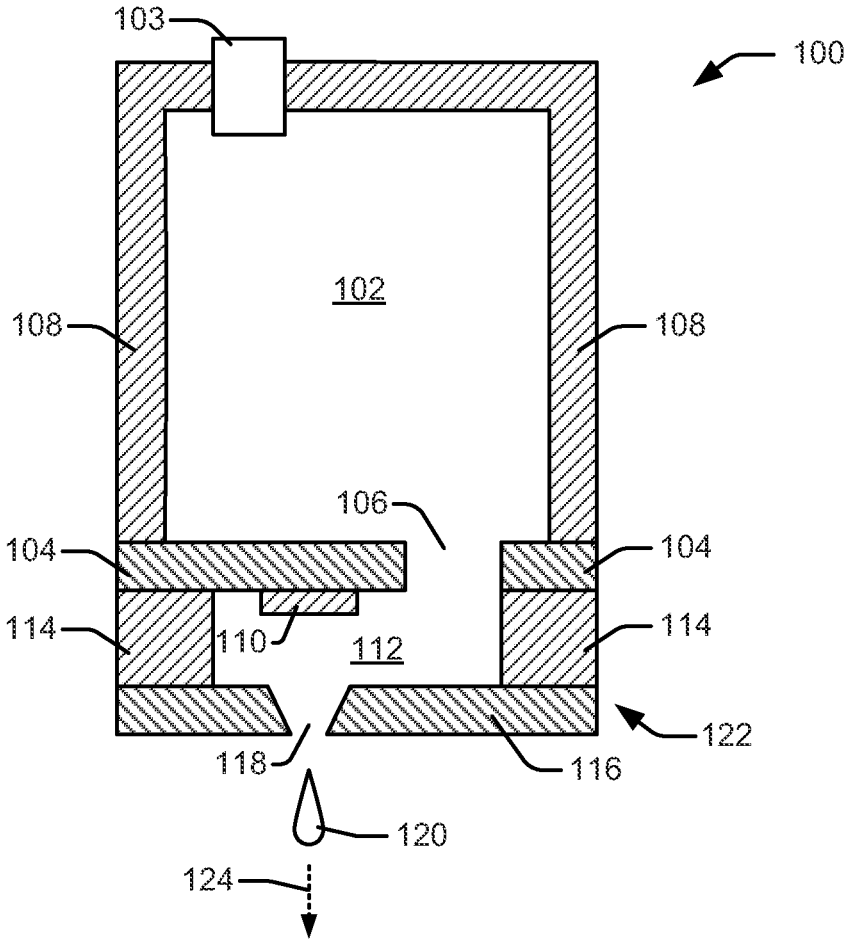
FIG. 1 shows an example of an inkjet pen that may incorporate a shipping fluid according to an embodiment.

As noted above, one reliability problem with the use of pigment-based inks in inkjet printing systems is the settling of the insoluble pigment particles that occurs during shipping and storage of the inkjet pen/printhead, which can impede or block the flow of ink to the printhead firing chambers and/or nozzles, resulting in poor image quality. Various methods are currently employed to overcome this problem. One method, for example, is the careful control of the pen/printhead supply chain. Pens containing pigment inks are shipped and stored in a nozzle-up configuration so that settling of the pigment particles does not clog the printhead nozzles. This method works fairly well in the higher end market segments, but not so well in the consumer market segments where supply chains are less controllable. The additional costs associated with controlling supply chains in this manner are also a disadvantage.

Another method for dealing with the settling problem in pigment inks and the potential clogging of the printhead firing chambers and nozzles is to provide a warranty period for pigment-based ink pens. The warranty period limits the shelf-life of the pen. It informs the consumer when the pen has "expired" and that a more recently manufactured inkjet pen should be purchased. An obvious disadvantage with this method is the additional costs associated with wasted product that results when pen warranties expire prior to the pens being sold.

Embodiments of the present disclosure overcome the settling problem with pigment inks and the resulting potential clogging of the printhead firing chambers and nozzles, without incurring the disadvantages associated with other methods such as those discussed above. Embodiments discussed herein include filling inkjet pens with pigment-free shipping fluid having a density that is different than the density of the ink that will be used in the pens. The density differential between the shipping fluid and the ink substantially prevents the intermixing of the ink with the shipping fluid in various circumstances, and it avoids the problem of clogging in the printhead firing chambers and nozzles often caused by settling pigments.

Shipping fluids have been used in pens/printheads before in a limited capacity. For example, in some inkjet printers, shipping fluid is used in the pen to protect the printhead during long storage periods. When the pen is first installed in the printer, the shipping fluid is purged from the pen and printhead in a conventional manner prior to beginning normal printing operations.

Although there has been some benefit derived from the use of shipping fluids, such as protecting the printhead during storage as noted above, there have also been problems associated with the use of shipping fluids in inkjet pens. First of all, the use of shipping fluids in the past has not protected against, nor has it been intended to protect against, the problem of poor out-of-box printhead performance caused by pigment particles settling into the firing chambers and/or nozzles of printheads during shipping and long storage of the pens. Thus, filling pens with shipping fluids such as de-ionized water may offer some protection during storage, but it does not guarantee protection against the problem of poor out-of-box printhead performance. Purging such shipping fluids from the pens/printheads prior to beginning printing operations can be problematic, because the purging requires a large amount of fluid and ink to be flushed through the system in order to restore accurate color performance. Typical printhead volumes are around 10 cc, and the required purge amounts are around 30 cc. This large (3×) purge volume is undesirable due to the limited capacity of most inkjet printer service stations as well as the significant time required to remove the fluid. The need for the large purge volume is at least in part due to the intermixing of the shipping fluid with the ink during the purge process.

As noted above, embodiments of the present disclosure substantially prevent intermixing between the shipping fluid and ink, and avoid the problem of poor out-of-box printhead performance caused by the settling of pigment particles into the firing chambers and/or nozzles of printheads. For example, in one embodiment an inkjet pen includes a printhead firing chamber, a nozzle plate having at least one nozzle in fluid communication with the firing chamber, and a layer of shipping fluid within the firing chamber and covering the nozzle plate and the at least one nozzle. The shipping fluid has a density that is different than that of the ink that will be ejected from the firing chamber to form an image on media.

In another embodiment a method of fabricating an inkjet pen includes forming a pen body having a fluid reservoir, forming a printhead having a firing chamber in fluid communication with the fluid reservoir through a fluid inlet passage, and filling the firing chamber with a layer of shipping fluid that covers a nozzle plate of the firing chamber, where the shipping fluid has a density that is greater than that of the ink that will be ejected from the firing chamber during a printing operation.

In yet another embodiment, a method of purging an inkjet pen includes installing the pen into a printer, applying a motive force to the shipping fluid within the pen, and expelling the shipping fluid from the pen through at least one nozzle using the motive force and a release of back pressure within the pen. The shipping fluid has a density that is greater than that of the ink that will be ejected from the pen in a printing operation.

First Illustrative Embodiment

FIG. 1 shows an example of an inkjet pen 100 (sometimes referred to as an inkjet cartridge) that may incorporate a shipping fluid according to an embodiment. A fluid reservoir 102 in the body of pen 100 is configured to hold fluid such as ink and/or shipping fluid. Depending on the particular pen device utilized, fluid port 103 facilitates the flow of fluid through the pen 100 either through communication with exterior air or through communication with an external ink supply through connection to a tube (not shown). That is, where the pen 100 includes a self-contained supply of ink, fluid port 103 facilitates the flow of the ink through the pen 100 through communication with exterior air which is drawn into the pen 100 as ink exits the other side of the pen 100 as discussed below. Where pen 100 is coupled to an external ink supply, fluid port 103 facilitates the flow of ink through the pen 100 through communication with the external supply via a tube (not shown) which carries ink under pressure from the supply to the pen.

Fluid reservoir 102 is fluidically coupled to a substrate 104 via fluid inlet passage 106. Depending on the particular pen device utilized, generally, substrate 104 is attached to the pen body 108. In alternate embodiments, substrate 104 may include integrated circuitry and may be mounted to what is commonly referred to as a chip carrier (not shown), which is attached to pen body 108. The substrate 104 generally contains an energy-generating element or fluid ejector 110 that generates a force utilized to eject essentially a drop 120 of fluid held in firing chamber 112. Fluid or drop ejector 110 creates a discrete number of drops of a substantially fixed size or volume. Two widely used energy generating elements are thermal resistors and piezoelectric elements. A thermal resistor rapidly heats a component in the fluid above its boiling point causing vaporization of the fluid component resulting in ejection of a drop 120 of the fluid. A piezoelectric element utilizes a voltage pulse to generate a compressive force on the fluid resulting in ejection of a drop 120 of the fluid. Although pen 100 is described as employing an ink drop generator that creates generally fixed-sized drops that are discretely ejected, other pen types or fluid ejection devices are contemplated such as those having hydraulic, air assisted, or ultrasonic nozzles that may form a spray of fluid having varying drop sizes.

Substrate 104, chamber layer 114, nozzle layer 116 (nozzle plate), nozzle(s) 118, and a flexible circuit (not shown) form what is generally referred to as a printhead 122. Chamber layer 114 forms the side walls of chamber 112, and substrate 104 and nozzle layer 116 form the bottom and top of chamber 112 respectively, where the substrate 104 is considered the bottom of the chamber 112. Pen 100 typically has a nozzle density on the order of 300 nozzles per inch, but in alternate embodiments may have nozzle densities that range from a single nozzle up to over a 1000 nozzles per inch. In addition, although pen 100 of FIG. 1 illustrates a nozzle layer 116 having a single nozzle 118 per fluid ejector 110 through which fluid is ejected, in alternate embodiments, each fluid ejector 110 may utilize multiple nozzles 118 through which fluid is ejected. Each activation of a fluid ejector 110 results in the ejection of a precise quantity of fluid in the form of essentially a fluid drop 120 with the drop 120 ejected substantially along fluid ejection axis 124.

Figure 2:
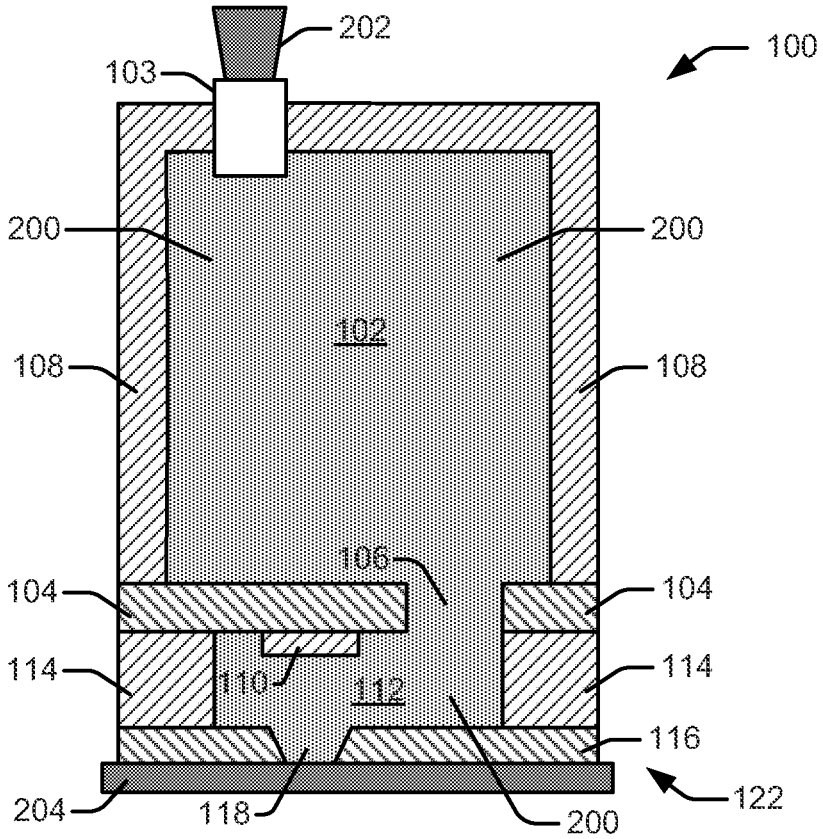
FIG. 2 shows an example of an inkjet pen that is fully filled with a shipping fluid according to an embodiment.

Referring to FIG. 2, in a first embodiment, pen 100 is fully filled with a shipping fluid 200. That is, pen 100 includes a shipping fluid 200 filling each cavity within the pen where ink would typically be located during a normal printing operation, such as the fluid reservoir 102, fluid inlet passage 106, and chamber 112. A significant advantage of this embodiment is that it provides manufacturing flexibility and reduced costs. The flexibility and cost savings are achieved by virtue of having to maintain only one fluid (i.e., the shipping fluid 200) on the manufacturing line to fill pens as opposed to maintaining a wide range of expensive, and time sensitive inks to fill the pens.

In this embodiment, as shown in FIG. 2, pen 100 also includes seals (202, 204) covering fluid port 103 and nozzle (s) 118, which prevent the shipping fluid 200 from leaking out of the pen 100 during shipping and storage. Typically, the seals include a plug 202 that covers fluid port 103 and a cap 204 that covers nozzle(s) 118. When the pen 100 is manufactured it is filled with shipping fluid 200 through the same process that would otherwise be used to fill the pen with ink. Processes for filling the pen with fluid are generally known and will therefore not be further discussed. In the present embodiment, therefore, when the pen is being manufactured, instead of being filled with ink during manufacture it is filled with shipping fluid 200 and sealed with seals, 202, 204, for shipping and storage.

Figure 3:
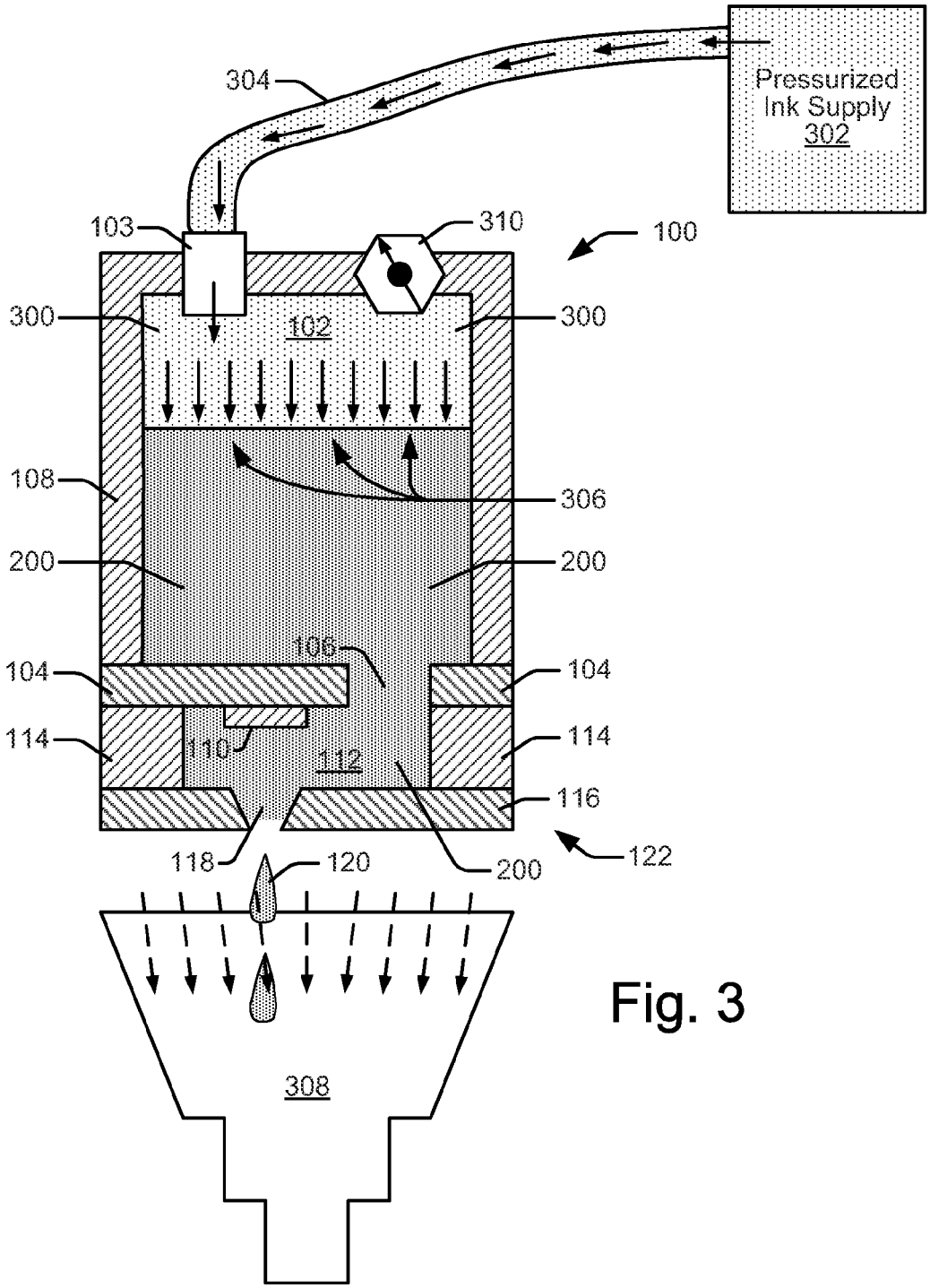
FIG. 3 shows an example of an inkjet pen that is coupled to an external, pressurized ink supply according to an embodiment.

Referring now to FIG. 3, shipping fluid 200 has a density that is different than the density of the ink 300 that will eventually fill the pen 100 and be ejected onto media in a normal printing operation. In the present embodiment, the shipping fluid 200 has a significantly higher density than the ink 300 to be used in pen 100. Although other density differentials between the shipping fluid 200 and ink 300 are contemplated, the density differential in the present embodiment is 0.02 to 0.1 grams per milliliter (0.02-0.1 g/mL).

FIG. 3 illustrates that when pen 100 is installed in a printer, fluid port 103 is coupled to an external, pressurized ink supply 302 through tube 304. After installation, a purge/refill process is performed to expel the shipping fluid 200 from the pen 100 and printhead 122 and refill them with ink 300. When the pen is filled from top to bottom as discussed further below, the amount of mixing that occurs is limited due to the differential densities in the shipping fluid 200 and ink 300. This essentially achieves a "plug" flow of the shipping fluid and ink fronts 306. In an alternative embodiment, the pen could be filled from bottom to top, in which case the ink would need to have a greater density than the shipping fluid.

The process of purging the shipping fluid 200 from pen 100 and refilling it with ink 300 can occur in several ways, and may depend in part on the configuration of pen 100. More specifically, for example, how the pen 100 is purged of the shipping fluid 200 and how, or if, the pen 100 is refilled with ink may depend on whether the pen 100 has a self-contained ink supply or whether the pen 100 relies on an external ink supply 302 such as in FIG. 3. Since the embodiment of pen 100 shown in FIG. 3 is completely filled with shipping fluid 200 during manufacturing, the purge process includes a corresponding refilling of the pen 100 with ink 300.

As noted above, upon installation of pen 100 in a printer, fluid port 103 is coupled to an external, pressurized ink supply 302 through tube 304. At least two possible methods of purging the shipping fluid 200 from pen 100 are illustrated in FIG. 3. In a first method, the shipping fluid 200 is drawn out of the nozzle(s) 118 through the use of a vacuum source 308 applied to the nozzle layer 116. In this process, shipping fluid 200 is sucked out of pen 100 through nozzle(s) 118 as ink 300 fills the pen from the top through fluid port 103. In another method, the shipping fluid 200 is expelled from the pen 100 through the process of blow priming. In the blow priming process, a back pressure that normally keeps ink from dripping out of the pen is released by a pressure regulation system 310. Once the pressure regulation system 310 releases the back pressure, the pressurized ink supply 302 forces the shipping fluid 200 out of the pen 100 through nozzle(s) 118 while refilling the pen with ink 300. In another method, the shipping fluid 200 is expelled from the pen 100 through the normal process of "spitting" through nozzle(s) 118. This process is discussed further below. In each of these purging methods, as noted above, the amount of mixing that occurs between the shipping fluid 200 and ink 300 is limited due to their differential densities which creates a "plug" flow of the shipping fluid and ink fronts 306.

Second Illustrative Embodiment

Figure 4:
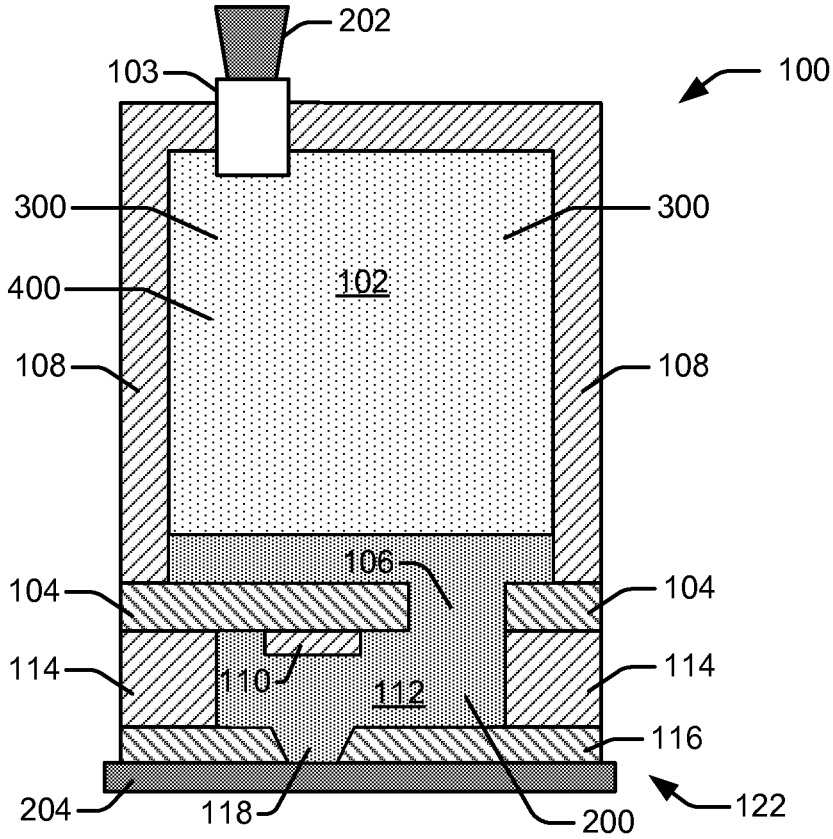
FIG. 4 shows an example of an inkjet pen that is not fully filled with shipping fluid according to an embodiment.
Figure 5:
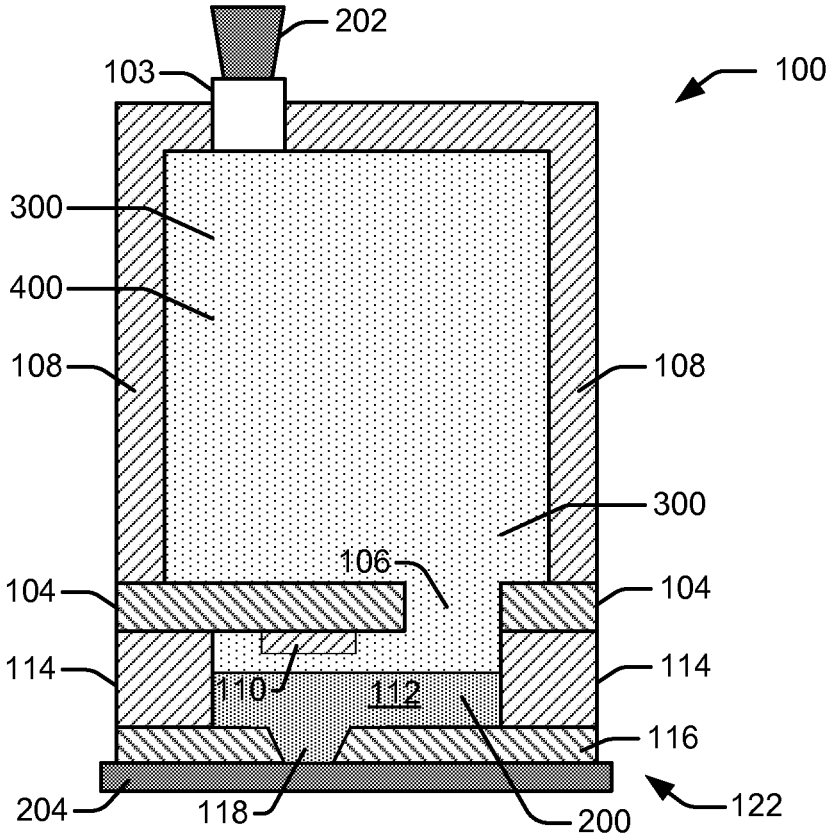
FIG. 5 shows an example of an inkjet pen that has a layer of shipping fluid covering the nozzle layer of the pen according to an embodiment.

FIG. 4 shows an example of an inkjet pen 100 that may incorporate a shipping fluid according to an embodiment. Fluid reservoir 102 is configured to hold fluid such as ink and/or shipping fluid. In this embodiment, pen 100 is not fully filled with shipping fluid 200 when it is manufactured. Rather, as illustrated in FIG. 4, pen 100 includes a self-contained supply 400 of ink 300 in addition to an amount of shipping fluid 200. Although FIG. 4 illustrates an amount of shipping fluid 200 that fills printhead 122 (i.e., firing chamber 112), fluid inlet passage 106, and a small portion fluid reservoir 102, it is to be understood that the amount of shipping fluid 200 introduced at the time of manufacturing into a pen 100 having a self-contained supply 400 of ink may vary depending on the particular design of the pen and printhead. For example, as shown in FIG. 5, the amount of shipping fluid 200 introduced to pen 100 is less than the amount in the pen of FIG. 4. In the FIG. 5 pen 100, there is a layer of shipping fluid 200 that covers the nozzle layer 116 and nozzle(s) 118, but it does not completely fill the firing chamber 112.

As noted above, among other things, the density differential between the shipping fluid 200 and ink 300 helps to avoid the problem of poor out-of-box printhead performance caused by the settling of pigment particles into the firing chambers and/or nozzles of printheads. As can be appreciated from the pen embodiment shown in FIG. 5, even a reduced layer of shipping fluid 200 having a higher density than the ink 300 will help prevent pigment particles from the ink 300 from settling into the firing chamber 112 and/or nozzles 118 of printhead 122. Furthermore, an additional purpose of certain embodiments of the present disclosure is to minimize the amount of fluid to be purged from the pen 100 upon installation of the pen into a printer. As noted above, typical printhead volumes are around 10 cc, and the required purge amounts are around 30 cc. This large (3×) purge volume is undesirable due to the limited capacity of most inkjet printer service stations as well as the significant time required to purge the fluid. The reduced layer of shipping fluid 200 in the pen embodiment of FIG. 5 minimizes the amount of purging needed upon installation of pen 100 into a printer. In the present embodiment, as discussed with respect to FIGS. 4 and 5, purge volumes can be as little as 12 cc for a 10 cc printhead.

Figure 6:
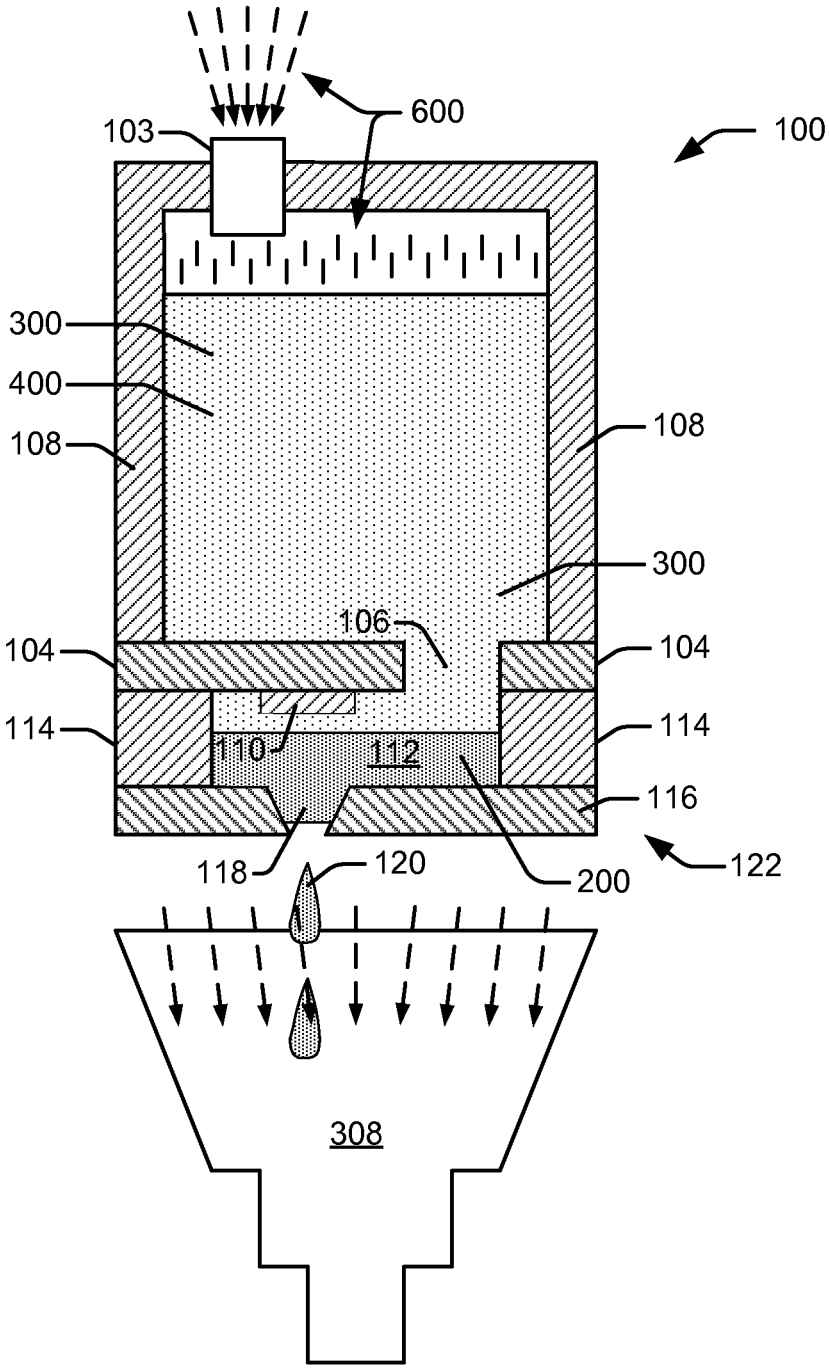
FIG. 6 shows an example of an inkjet pen during one or more purging operations according to an embodiment.

In the FIG. 4 embodiment of pen 100, the ink supply stored in reservoir 102 is not intended to be replenished by an external ink supply as in the previous embodiment discussed with respect to FIGS. 2 and 3. Rather, when the supply of ink in fluid reservoir 102 is depleted, the user simply replaces the pen 100 with a new pen having another supply of ink. Prior to use, however, the shipping fluid 200 is purged from the pen 100 as in the previous embodiment. Referring now to FIG. 6, purging the shipping fluid 200 from a pen having a self-contained ink supply 400 can be achieved in a number of ways. For example, as with the previous embodiment of pen 100 (FIGS. 2 and 3), the shipping fluid 200 can be drawn out of the nozzle(s) 118 through the use of a vacuum source 308 applied to the nozzle layer 116. In this process, shipping fluid 200 is sucked out of pen 100 through nozzle(s) 118 as air 600 allowed in through fluid port 103 relieves the negative pressure that would otherwise be generated by the removal of shipping fluid 200. It is to be noted that the amount of air 600 shown entering pen 100 of FIG. 6 is exaggerated for the purpose of illustration.

Another method of purging shipping fluid 200 from a pen having a self-contained ink supply 400 is through a normal process called "spitting" that is used both when printing an image onto media and/or when performing a maintenance operation on the printhead. As noted above, fluid ejector 110 (e.g., a thermal resistor or piezoelectric element) generates a force utilized to eject a drop 120 of fluid held in firing chamber 112. This ejection process is known as spitting, and it is used to form an image on a print medium such as paper. In addition, during normal printing operations as ink is repeatedly ejected from the nozzle(s) 118 to form images, ink can build up over time on a surface of the nozzle and/or nozzle plate 116. The build up can interfere with the ejection of ink droplets and reduce print quality. A maintenance operation is sometimes performed that includes both spitting and wiping away residual ink left on the nozzle(s) 118 and/or nozzle plate 116 to help prevent this problem. Thus, spitting can also be used to purge shipping fluid 200 from pen 100 as air 600 is allowed in through fluid port 103 to relieve negative pressure that would otherwise build up through the removal of the shipping fluid 200.

Third Illustrative Embodiment

Figure 7:
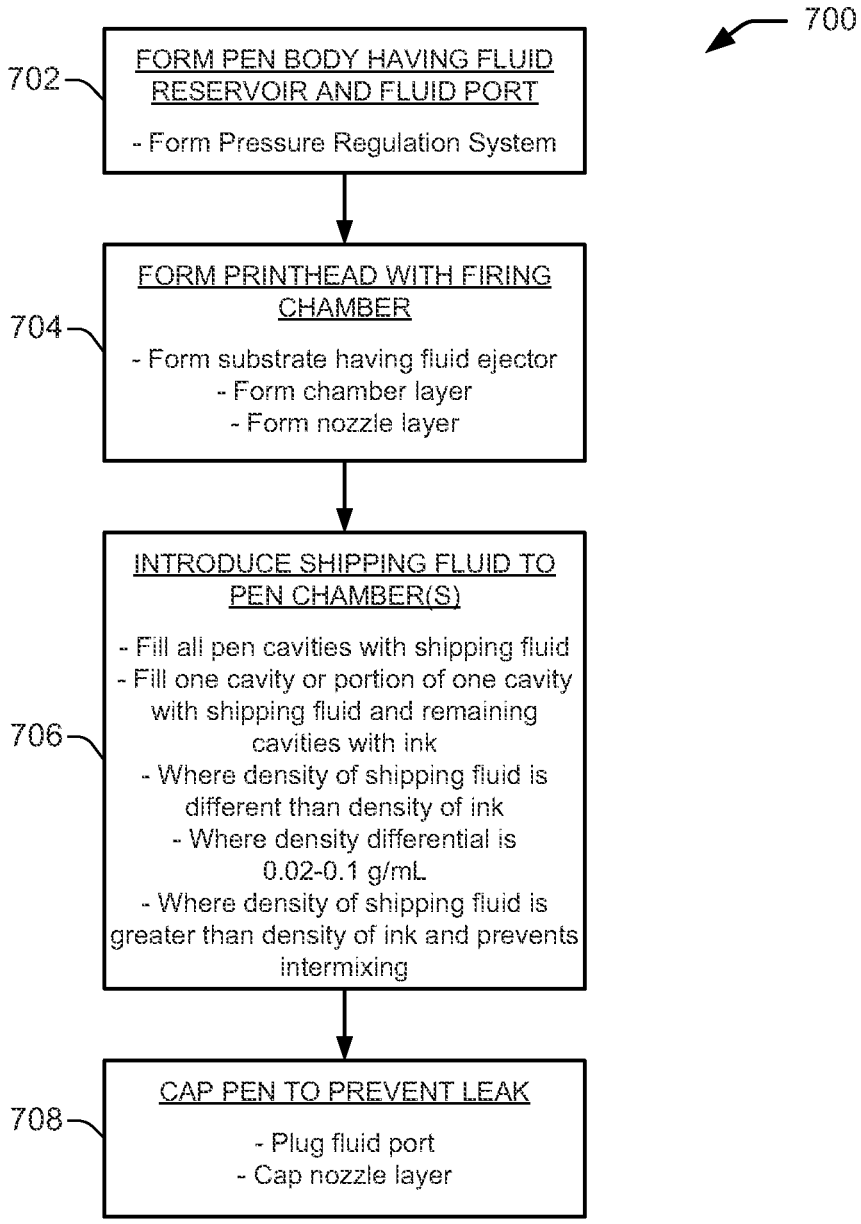
FIG. 7 shows a flowchart of a method of fabricating an inkjet pen according to an embodiment.

FIG. 7 shows a flowchart of a method 700 of fabricating an inkjet pen 100 that includes introducing a shipping fluid 200 into the pen during fabrication. Method 700 is associated with the embodiment of inkjet pen 100 illustrated in FIGS. 2 and 3 and the related description above. Fabricating an inkjet pen 100 through the method of 700 helps to prevent settling of insoluble pigment particles from pigmented ink that occurs during shipping and storage of the inkjet pen/printhead, which can impede or block the flow of ink to the printhead firing chambers and/or nozzles, resulting in poor image quality.

Method 700 begins at block 702 with forming a pen body 108 having a fluid reservoir 102 and fluid port 103. The fluid reservoir 102 in the body of pen 100 is configured to hold fluid such as ink and/or shipping fluid. Fluid port 103 facilitates the flow of fluid through the pen 100 either through communication with exterior air or through communication with an external ink supply. Forming the pen body 108 may also include forming a pressure regulation system 310 useful in regulating pressure within the pen 100. Method 700 continues at block 704 with forming a printhead 122 having a firing chamber 112. Forming printhead 122 includes forming a substrate 104 fluidically coupled to reservoir 102 through a fluid inlet passage 106. Forming printhead 122 further includes forming a chamber layer 114 and a nozzle layer 116, which together define firing chamber 112. Substrate 104 generally includes an energy-generating element or fluid ejector 110 that generates a force utilized to eject a drop 120 of fluid held in firing chamber 112.

Method 700 continues at block 706 with introducing shipping fluid 200 into one or more of the pen cavities. This may include filling all of the pen cavities with shipping fluid 200, or it may include filling one cavity or a part of one cavity. For example, introducing shipping fluid 200 into pen 100 may include filling each cavity within the pen with shipping fluid 200 where ink would typically be located during a normal printing operation, such as the fluid reservoir 102, fluid inlet passage 106, and chamber 112. However, introducing shipping fluid 200 into pen 100 may include filling only a portion of the firing chamber 112 with shipping fluid 200. In the case where all of the pen cavities are not filled with shipping fluid 200, the method 700 may also include filling the remainder of the pen cavities with ink 300.

Shipping fluid 200 has a density that is different than the density of the ink 300 that will eventually fill the pen 100 and be ejected onto media in a normal printing operation. In the present embodiment, the shipping fluid 200 has a significantly higher density than the ink 300 to be used in pen 100. Although other density differentials between the shipping fluid 200 and ink 300 are contemplated, the density differential in the present embodiment is 0.02 to 0.1 grams per milliliter (0.02-0.1 g/mL).

Method 700 continues at block 708 with capping the pen 100 to prevent the shipping fluid 200 and/or ink 300 from leaking out of the pen 100. Capping the pen 100 typically includes covering fluid port 103 and nozzle(s) 118 (and/or nozzle layer 116) with a seal. For example, a plug 202 may be used to seal fluid port 103 and a cap 204 may cover nozzle(s) 118 (and/or nozzle layer 116).

A significant advantage of this method of fabricating an inkjet pen 100, is that it can provide manufacturing flexibility and cost savings through not having to maintain a wide range of expensive, and time sensitive inks on a manufacturing line. The shipping fluid 200 may be all that needs to be maintained on the manufacturing line.

Fourth Illustrative Embodiment

Figure 8:
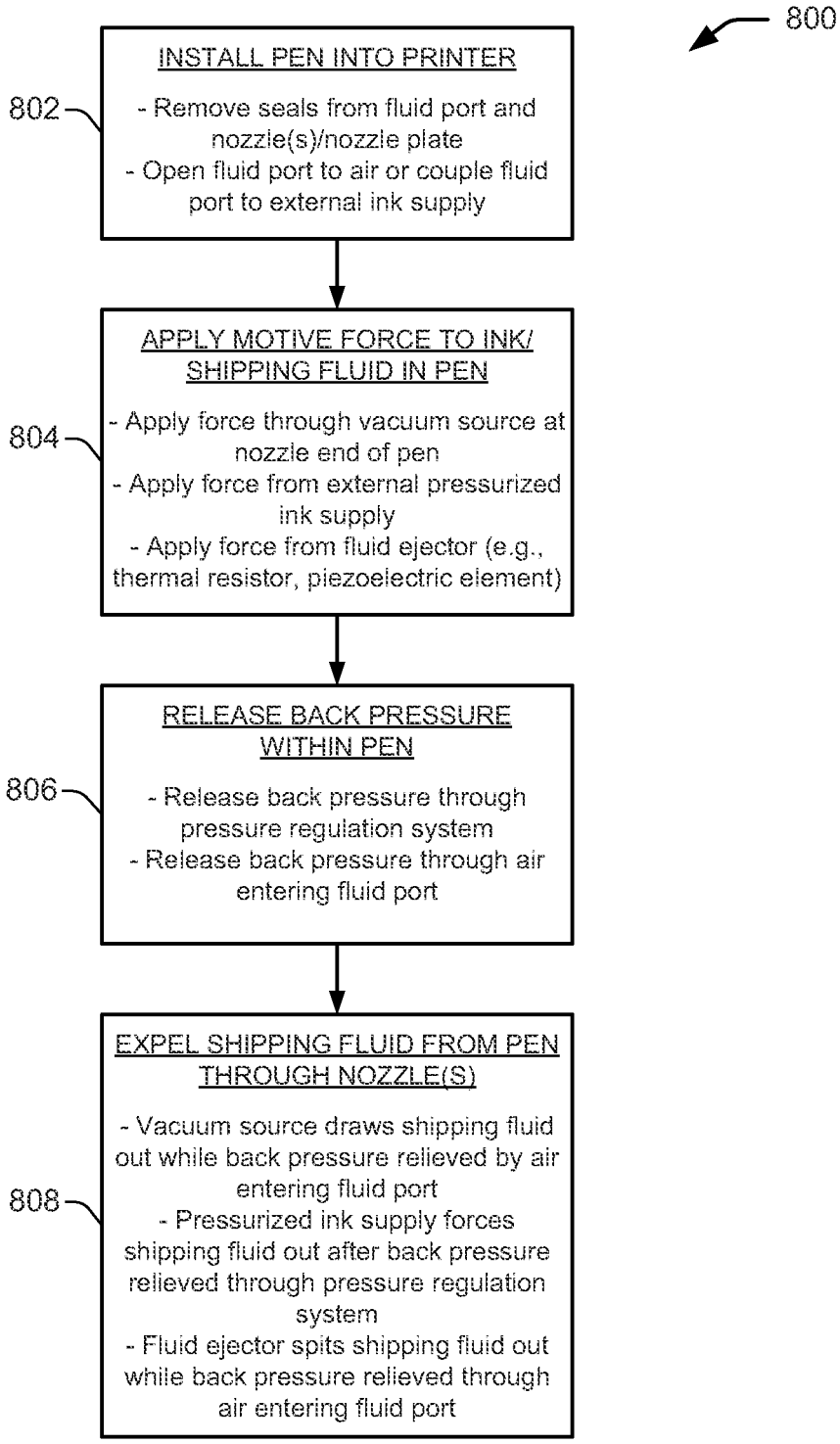
FIG. 8 shows a flowchart of a method of purging an inkjet pen according to an embodiment.

FIG. 8 shows a flowchart of a method 800 of purging an inkjet pen 100 that includes shipping fluid 200. Method 800 is generally associated with the embodiments of inkjet pens 100 illustrated in FIGS. 2 through 6 and the related description above. Purging the shipping fluid 200 from inkjet pen 100 through the method of 800 helps to improve out-of-box pen performance by preventing intermixing between the shipping fluid and ink, and by preventing blockage of ink flow to printhead firing chambers and/or nozzles that may otherwise occur due to the settling of insoluble pigment particles from pigmented ink after shipping and storage.

Method 800 begins at block 802 with the installation of pen 100 into a printer. The installation typically includes the removal of seals that have been installed on the pen during fabrication such as, for example, a plug 202 that may be present to seal fluid port 103 and a cap 204 that may be covering nozzle(s) 118 (and/or nozzle layer 116). In addition, installation of pen 100 into a printer may include opening of fluid port 103 to the air, or the coupling of fluid port 103 to an external ink supply 302 through a tube 304.

Method 800 continues at block 804 with the application of a motive force to the ink 300 and/or shipping fluid 200 within the pen 100. Shipping fluid 200 has a density that is different than the density of the ink 300 used in the pen 100 in normal printing operations. In the present embodiment, the shipping fluid 200 has a significantly higher density than the ink 300 to be used in pen 100. Although other density differentials between the shipping fluid 200 and ink 300 are contemplated, the density differential in the present embodiment is 0.02 to 0.1 grams per milliliter (0.02-0.1 g/mL). In one implementation, the force applied to the ink 300 and/or shipping fluid 200 may be exerted by a vacuum source 308 applied at the nozzle end of pen 100. In another implementation, the force may be applied by an external pressurized ink supply 302, for example, that pushes from the top or fluid port end of the pen. In yet another implementation, the force may be applied by a fluid ejector 110 such as a thermal resistor or piezoelectric element that generates a force to eject fluid held in firing chamber 112.

Method 800 may further include the step of releasing a back pressure within the pen 100, for example, through a pressure regulation system 310. Back pressure may also be released in the pen through air entering fluid port 103 in the case where pen 100 has a self-contained ink supply 400 and is not coupled to an external pressurized ink supply.

One or a combination of steps 804 and 806 results in the expulsion of shipping fluid 200 from the pen 100 through nozzle(s) 118, as shown at block 808. In one implementation, for example, a vacuum source 308 applied at the nozzle end of pen 100 draws shipping fluid 200 out of the pen through nozzle(s) 118 while back pressure from the exiting fluid is relieved through air entering the pen through fluid port 103. In another implementation, a pressurized ink supply 302 forces shipping fluid 200 out of the pen through nozzle(s) 118 after pen back pressure is relieved through a pressure regulation system 310. In another implementation, a fluid ejector 110 such as a thermal resistor or piezoelectric element forces (i.e., "spits") shipping fluid 200 out of the pen through nozzle(s) 118 after while back pressure from the exiting fluid is relieved through air entering the pen through fluid port 103 or after pen back pressure is relieved through a pressure regulation system 310.

What is claimed is:

1. An inkjet pen comprising:

a printhead firing chamber;

a nozzle plate having at least one nozzle in fluid communication with the firing chamber; and a layer of shipping fluid within the firing chamber and covering the nozzle plate and the at least one nozzle, the shipping fluid having a density different than that of ink that will be ejected from the firing chamber to form an image on media.

2. An inkjet pen as in claim 1, wherein the shipping fluid density is greater than the ink density.

3. An inkjet pen as in claim 1, wherein the density differential between the shipping fluid and the ink is 0.02 to 0.1 grams per milliliter.

4. An inkjet pen as in claim 1, further comprising:

a pen body fixed to the printhead; and a fluid reservoir formed in the pen body and in fluid communication with the firing chamber through a fluid inlet passage, and wherein the fluid reservoir, fluid inlet passage and firing chamber are completely filled with the shipping fluid.

5. An inkjet pen as in claim 1, further comprising:

a pen body fixed to the printhead; and a fluid reservoir formed in the pen body and in fluid communication with the firing chamber through a fluid inlet passage, wherein the fluid reservoir is filled with a self-contained ink supply.

6. An inkjet pen as in claim 5, wherein the self-contained ink supply extends to fill the fluid inlet passage and that portion of the firing chamber that is not filled by the layer of shipping fluid covering the nozzle plate and the at least one nozzle, and wherein the density differential between the shipping fluid and the ink prevents intermixing between the shipping fluid and the ink.

7. An inkjet pen as in claim 1, further comprising:

a fluid port sealed with a plug; and a cap covering and sealing the nozzle plate.

8. An inkjet pen as in claim 1, further comprising a pressure regulation system to regulate pressure within the pen and facilitate purging of the shipping fluid from the pen.

9. A method of fabricating an inkjet pen comprising:

forming a pen body having a fluid reservoir;

forming a printhead having a firing chamber in fluid communication with the fluid reservoir through a fluid inlet passage; and filling the firing chamber with a layer of shipping fluid that covers a nozzle plate of the firing chamber, the shipping fluid having a density that is greater than that of ink that will be ejected from the firing chamber during a printing operation.

10. The method of claim 9, further comprising:

filling with ink, the fluid reservoir, the fluid inlet passage and that portion of the firing chamber not filled with the shipping fluid; and preventing intermixing between the ink and the shipping fluid through the density differential of the shipping fluid and the ink.

11. The method of claim 9, further comprising filling each of the fluid reservoir, the fluid inlet passage, and the firing chamber with the shipping fluid such that all cavities within the pen are filled with the shipping fluid.

12. The method of claim 9, further comprising:

forming a fluid port in the pen body for filling cavities of the pen;

forming a pressure regulation system in the pen body; and sealing the fluid port and the nozzle plate to prevent shipping fluid and ink from leaking out of the pen.

13. A method of purging an inkjet pen comprising:

installing the pen into a printer;

applying a motive force to shipping fluid within the pen, where the shipping fluid has a density that is greater than that of ink that will be ejected from the pen in a printing operation; and expelling the shipping fluid from the pen through at least one nozzle with the motive force and a release of back pressure within the pen.

14. The method of claim 13, wherein installing the pen comprises:

removing seals from a fluid port and a nozzle plate;

opening the fluid port to air when the pen has a self-contained ink supply; and coupling the fluid port to an external pressurized ink supply when the pen does not have a self-contained ink supply.

15. The method of claim 13, wherein expelling the shipping fluid is selected from the group comprising:

drawing the shipping fluid from the pen through at least one nozzle with a vacuum source while relieving back pressure with air entering the fluid port;

forcing the shipping fluid from the pen through at least one nozzle with a pressurized ink supply after relieving back pressure through a pressure regulation system; and spitting the shipping fluid from the pen through at least one nozzle with a fluid ejector while relieving back pressure with air entering the fluid port.

* * * * *